US006726599B1

(12) United States Patent
Stonecipher

(10) Patent No.: US 6,726,599 B1
(45) Date of Patent: Apr. 27, 2004

(54) OPEN HAND GRIPPED EXERCISE DEVICE

(75) Inventor: William L. Stonecipher, Overland Park, KS (US)

(73) Assignee: Top Form FItness Systems, Inc., Overland Park, KS (US)

( * ) Notice: Subject to any disclaimer, the term of this patent is extended or adjusted under 35 U.S.C. 154(b) by 52 days.

(21) Appl. No.: 10/004,908

(22) Filed: Nov. 2, 2001

(51) Int. Cl.[7] ..... A63B 21/00
(52) U.S. Cl. ..... 482/44; 482/46
(58) Field of Search ..... 482/44–47, 49, 482/50, 92, 93, 106, 107, 111, 112

(56) References Cited

U.S. PATENT DOCUMENTS

| | | | | | |
|---|---|---|---|---|---|
| 2,475,656 | A | | 7/1949 | Bidak | |
| 3,033,565 | A | | 5/1962 | Wolski | |
| 3,330,558 | A | * | 7/1967 | Simons | 482/46 |
| 3,690,655 | A | | 9/1972 | Chapman | |
| 3,982,755 | A | | 9/1976 | Sarich | |
| 4,632,391 | A | | 12/1986 | Orak | |
| 4,869,491 | A | * | 9/1989 | Nolan | 482/45 |
| 4,973,043 | A | * | 11/1990 | Nolan | 482/45 |
| 5,116,297 | A | | 5/1992 | Stonecipher | |
| 5,449,333 | A | * | 9/1995 | Carter | 482/107 |
| 5,692,944 | A | | 12/1997 | Pellicone | |
| 5,788,617 | A | * | 8/1998 | Paris | 482/112 |

* cited by examiner

*Primary Examiner*—Glenn E. Richman
(74) *Attorney, Agent, or Firm*—Erickson & Kleypas LLC

(57) ABSTRACT

An open hand gripped exercise device includes an internal frame having an H-shape formed by a center bar assembly and end bar assemblies. The center bar assembly is adjustable in length, with outer sections secured perpendicularly to the end bar assemblies. The end bars have threaded ends to receive additional weight plates and retaining collars to adjust the overall weight of the device. The center bar and end bars have resilient cylindrical pads sleeved thereon to provide such a diameter as to require an open handed grip of the device for use in exercises.

21 Claims, 2 Drawing Sheets

18
20
22
9
3
18
22
30
28
4
7
4
2
16
6
32
1
22
20
7

1
3
2
7
7
16
6
4
1
1
6
7

Fig. 3.
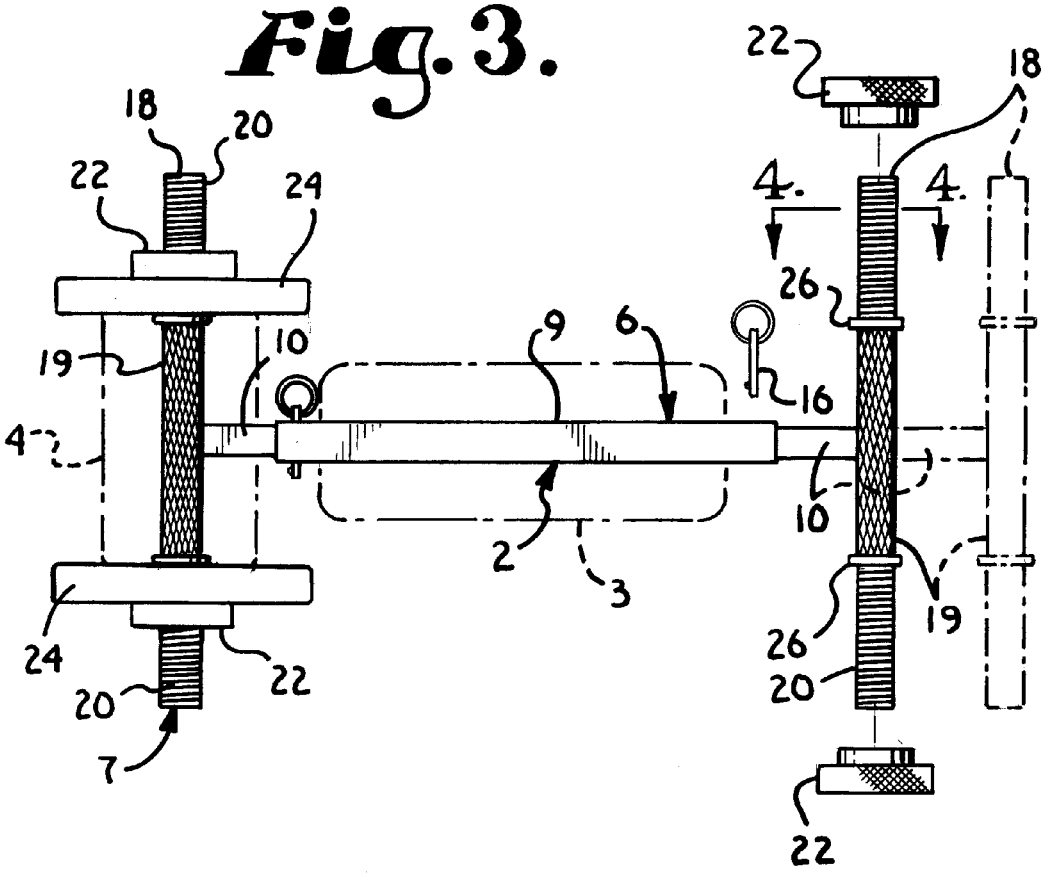
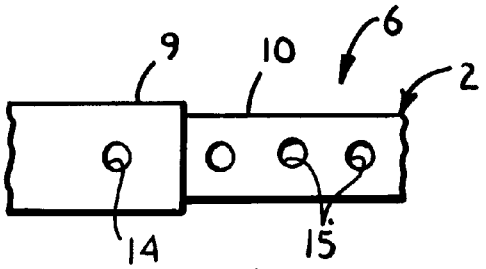
Fig. 4.

OPEN HAND GRIPPED EXERCISE DEVICE

BACKGROUND OF THE INVENTION

Physical vitality and fitness are improved and maintained by exertion of the body. Various exercises and activities have been devised to enhance overall fitness and to condition specific muscles and muscle groups. Resistance exercise, also called strength training, increases muscle strength and mass and bone strength and improves metabolism. Resistance training can employ free weights, weight machines, and calisthenics. With free weights, such as dumbbells or barbells, the exerciser determines the ranges of motions of the weights as they are lifted. On the other hand, weight machines use the structure of the machine to control the type of movements which can be applied to lifting captive weights. In calisthenics, such as chin-ups, push-ups, sit-ups, "jumping jacks", and the like, the weight of the exerciser's own body is used as a resistence force to be worked against.

Exercises can be classified by their effects on muscles and according to the character of motion involved. In isometric exercises, muscles contract, but there is no decrease in length. Some muscles may work against other muscles or against a fixed, or relatively fixed, object. Isokinetic exercise refers to exercises which permit maximum muscle contraction throughout the full range of movement of a joint associated with the muscle. Pliometric exercises refer generally to types of exercise in which movement of an object is halted, then reversed in direction of movement. An example of a pliometric exercise is catching and then throwing back a "medicine" ball.

There are a large number of devices, apparatus, and equipment for use in performing various types of exercises, such as the weight machines and free weights mentioned above. Weight machines and barbells tend to be large, heavy, and expensive, as do various type of treadmill machines, weight and exercise benches, and spring based exercise machines. There are also a large number of small, inexpensive devices for use in specific types of strength training and exercises. A large proportion of exercise devices are designed for use by manual grasping and manipulation. In most cases, such grasped devices are sized to be gripped with closed, or mostly closed, hands.

Although there are benefits to be realized using such closed hand gripped devices, it has been found that there are also benefits to exercise devices which cannot be gripped with a closed hand, but which must be supported with open hands. The benefits of such an open handed device involve the necessity of combining isometric muscle contractions with otherwise isokinetic or pliometric types of exercises. The isometric contractions result from the need to clamp or compress such a device between the open palms of the hands to support the device.

SUMMARY OF THE INVENTION

The present invention provides an open hand gripped exercise device to provide muscle exercising benefits resulting from performing exercises with a weighted device which is supported by the user's hands in an open configuration. The preferred device includes an H-shaped inner frame formed by a center bar and end bars connected perpendicularly to ends of the center bar. The end bars, and preferably the center bar, have cylindrical cushions sleeved thereon to increase their gripped diameter. The cushions have limited resilience so that the device must be gripped with the hands substantially opened.

The center bar is preferably adjustable in length and includes a center section with end sections telescopically engaged thereto. Removable fasteners secure the end sections to the center section. The end bars are connected in T-shaped joints to the end sections of the center bar. Opposite ends of the end bars are adapted to receive additional weights. The ends of the end bars may be threaded to receive retainer collars to hold combinations of conventional dumbbell type plates on the end bars.

The exercise device can be used in a number of types of exercise devices, such as free weight types of lifting exercises like presses and curls and other lifting exercises, such as those in which one arm opposes movement of the other. The exercise device can also be used to enhance the effect of calisthenic type exercises, such as sit-ups, jumps of various kinds, abdominal twists, lunges, and even running. In most of the preferred exercises with the device, it is gripped in an open handed manner. This requires isometric contraction of muscles used for effecting a grip on the device.

The center bar can be extended to increase the separation of the end bars for exercises which make use of rotational momentum. The extended configuration can also enable a more secure grip of the device, such as if additional weights are placed on the end bars. The separability of the end bars from the center bar facilitates packing and storing the components of the exercise device.

Other objects and advantages of this invention will become apparent from the following description taken in relation to the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE DRAWINGS

FIG. 3 is a partially exploded, side elevational view of frame members and weighted collars of the exercise device, with grip cushions, and an alternative position of an end bar shown in phantom lines.

FIG. 4 is a greatly enlarged sectional view taken on line 4—4 of FIG. 3 and illustrates a series of apertures to enable extension of a center bar of the exercise device of the present invention.

DETAILED DESCRIPTION OF THE INVENTION

Figure 1:
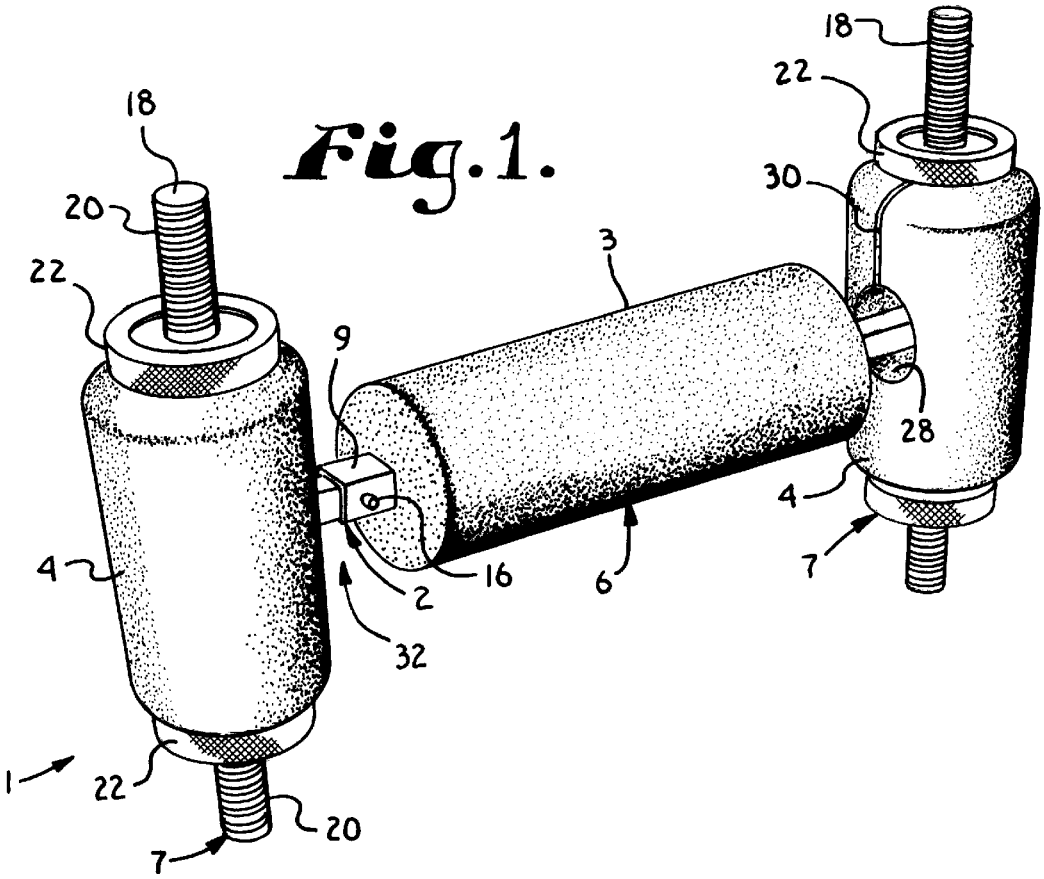
FIG. 1 is a perspective view of an open hand gripped exercise device which embodies the present invention.
Figure 2:
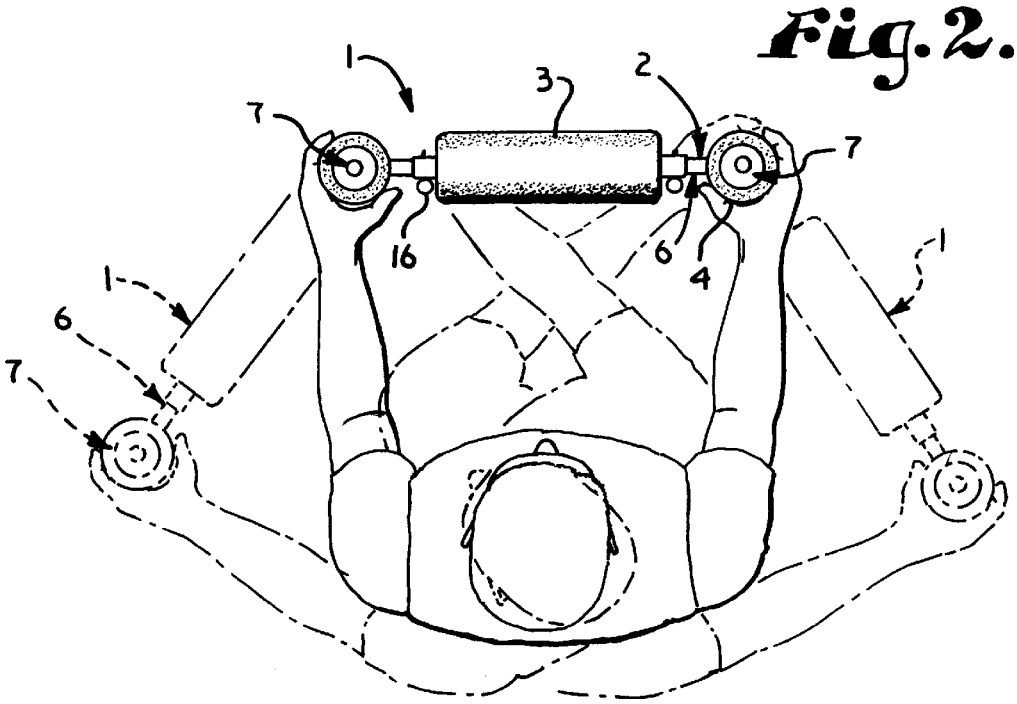
FIG. 2 is a top plan view at a reduced scale and illustrates gripping of the exercise device by a user in a substantially open handed manner, with movement of the device by the user shown in phantom lines.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates an open hand gripped exercise device which embodies the present invention. The device 1 generally includes an inner frame 2 and external cushions 3 and 4 sized to conform to a substantially open handed grip of a user of the device 1 when used for exercises.

Referring to FIG. 3, the preferred frame 2 is H-shaped and includes a center bar assembly 6 and opposite end bar assemblies 7. The center bar assembly 6 includes a center section 9 and a pair of end stub sections 10 telescoped into the center section 9. The illustrated center bar sections 9 and 10 are tubular and of square cross section, although other cross sectional shapes could alternatively be employed. As shown in FIG. 4, the center section 9 is provided with apertures 14 at its opposite ends and the end stub sections 10 with apertures 15. The apertures 15 are selectively aligned with the apertures 14 to receive a fastener 16, such as a "cotterless" pin, to secure the end sections 10 to the center section 9, by snapping the fastener 16 into the aligned holes 14 and 15. The apertures 14 and 15 and fastener 16 enable the length of the center bar assembly 6 to be adjusted through a range of about two feet to three feet.

The preferred end bar assemblies 7 are solid rods 18, each having a center rod section 19 and a pair of end rod sections 20. The end section 10 the each center bar assemblies 6 are connected to the center rod sections 19, as by welding, to form perpendicular or T-shaped joints. The end rod sections 20 are threaded to receive internally threaded collars or nuts 22. The collars 22 provide a means of securing external weight plates 24 to the rod assemblies 7. The collars 22 add weight to the device 1 and may be placed on the rods 18, or not, as desired by the user. The rods 18 may include stop shoulders 26 to restrict the position of a weight plate 24 on the rods 18 to the end sections 20 of the rods 18 and to prevent threading a collar 22 onto a center section 19 of a rod 18.

The illustrated center bar cushion 3 and end bar cushions 4 are cylindrical in shape and centrally bored to be received on the center bar 6 and the end bars 7 respectively. The cushions 3 and 4 may be formed of foam plastic of medium density and resilience. The cushions 3 and 4 have an outer diameter which requires a substantially open handed grip by a user to grasp the cushions 3 and/or 4 to support the device during exercising and, preferably, have a diameter in a range of about four to six inches. Although not illustrated, the cushions 3 and 4 may include an outer covering, such as leather or a plastic sheeting material, to protect the cushions. The illustrated end bar cushions 4 have a cross bore 28 and an end slit 30 (FIG. 1) to facilitate placement of the cushions 4 on the end bar rods 18 and to provide clearance around the end stubs 10 of the center bar assembly 6. Although it is desirable for the diameter of the cushions 3 and 4 to be of such a diameter as to require an open handed grip, it is recognized that, for safety, a secure grip on the device 1 is also necessary. In the illustrated device 1, there is a gap 32 between the ends of the center cushion 3 and the end cushions 4 in the region of the joint between the center section 9 and end sections 10 of the center bar assembly 6.

The gap 32 provides access to the fasteners 16 to adjust the length of the center bar assembly 6 and also allows secure gripping of the device 1. When the center bar assembly 6 is extended, the gap 32 is correspondingly increased, providing an expanded length of center bar 6 for gripping.

The illustrated exercise device 1 weighs from eight to ten pounds, without the collars 22. The collars 22 weigh about one pound apiece. The end rods 18 are similar to conventional dumbbell bars and are adapted to receive conventional weight plates, such as the plates 24. Common weight increments for the plates 24 are 1.25, 2.5, and 5 pounds. It is foreseen that other weight increments could be employed, such as metric increments. The total weight of the device 1 is limited by the length of the rods 18 and the ability of the user to safely lift and manipulate such weight. It should be noted that significant training benefits can be realized using only the device 1 with the collars 22. It is generally recommended that only minimal amounts of weight be added to the basic device 1, for most exercises.

The device 1 has utility in a wide variety of exercises. A particular feature of the device 1 is the sizing of the center cushion 3 and end cushions 4 to encourage an open-handed grip of the device during exercises. An open-handed grip requires constant contraction of certain muscles to support and control the device 1. As a result, a clamping or compressing approach to supporting the device 1 is required, thus providing isometric or quasi-isometric exercise of the arms and upper body, in addition to muscles used for other aspects of the exercises, such as manipulation of the device. As used herein, an open handed grip generally refers to a grip in which the curvature of the hand from the tips of the fingers to the tip of the thumb is generally C-shaped and forms approximately half a circle or less.

It is to be understood that while certain forms of the present invention have been illustrated and described herein, it is not to be limited to the specific forms or arrangement of parts described and shown. For example, it is foreseen that the center bar assembly 6 could be a single bar or rod of fixed length with the end bar assemblies 7 welded to opposite ends thereof (not shown). It is also foreseen that the center bar assembly 6 could comprise an outer telescoping member connected to one of the end bar assemblies 7 and an inner telescoping member connected to the other end bar assembly 7. The inner telescoping member would then be telescopingly received within the outer telescoping member. It is also foreseen that the center bar assembly 6 could be made adjustable without the use of fasteners as such. For example, a detent mechanism (not shown) could be engaged between telescoping members of the center bar assembly 6.

What is claimed and desired to secure by Letters Patent is:

1. An exercise device comprising:

(a) an elongated center bar having opposite ends;

(b) a pair of end bars attached to said opposite ends of said center bar in perpendicular relation to said center bar; and (c) each end bar having a grip member extending coaxially around said end bar, said grip member having a diameter sufficient to conform to a substantially open-handed grip.

2. A device as set forth in claim 1 wherein:

(a) said end bars have a sufficient amount of inherent weight and weight connected thereto to exercise muscles of a user in gripping said grip members and in moving of said device relative to a body of said user.

3. A device as set forth in claim 1 and including:

(a) a resilient, cylindrical center sleeve member received on said center bar.

4. A device as set forth in claim 1 wherein:

each end bar is releasably connected to a respective end of said center bar.

5. A device as set forth in claim 1 wherein each end bar includes:

(a) a fastening mechanism to enable releasable connection of a weight member thereto.

6. A device as set forth in claim 1 wherein:

(a) each end bar includes opposite-grip ends;

(b) each grip end is, threaded; and (c) a threaded grip collar is received on each grip end to releasably retain a weight member on said grip end.

7. A device as set forth in claim 1 wherein:

(a) each grip member is cylindrical and said grip diameter is in a range of approximately four to six inches.

8. A device as set forth in claim 1 wherein:

(a) said center bar is adjustable in length to enable selective variation in spacing between said grip members.

9. An exercise device comprising:

an elongated center bar having opposite ends;

a resilient, cylindrical center sleeve member received on said center bar;

a pair of end bars releasably secured to said opposite ends of said center bar in mutually parallel relation and in perpendicular relation to said center bar;

each end bar having thereon a resilient, cylindrical end sleeve member to form a grip member with the associate end bar, said end sleeve member having a diameter sufficient to require gripping same with a substantially open hand;

each of said end bars having a fastening mechanism thereon to enable releasable connection of a weight member thereto; and said end bars having a sufficient amount of inherent weight or weight members connected thereto to exercise muscles of a user in gripping said grip members and in moving of said device relative to a body of said user.

10. A device as set forth in claim 9 wherein each end bar includes:

(a) a fastening mechanism to enable releasable connection of a weight member thereto.

11. A device as set forth in claim 9 wherein:

(a) each end bar includes opposite grip ends;

(b) each grip end is threaded; and (c) a threaded grip collar is received on each grip end to releasably retain a weight member on said grip end.

12. A device as set forth in claim 9 wherein:

(a) said grip diameter is in a range of approximately four to six inches.

13. A device as set forth in claim 9 wherein:

(a) said center bar includes a center section and a pair of opposite end section;

(b) said center section and said end sections are telescopically engaged to selectively adjust an overall length of said center bar; and (c) a respective center bar fastener is engaged between said center section and an associated end section to releasably secure said end section to said center section.

14. An exercise device comprising:

(a) an elongated center bar having opposite ends;

(b) a pair of end bars attached to said opposite ends of said center bar in approximately perpendicular relation to said center bar; and (c) each end bar having a resilient grip member extending coaxially around said end bar.

15. A device as set forth in claim 14 wherein:

(a) said end bars have a sufficient amount of inherent weight and weight connected thereto to exercise muscles of a user in gripping said grip members and in moving of said device relative to a body of said user.

16. A device as set forth in claim 14 and including:

(a) a resilient, cylindrical center grip member received on said center bar.

17. A device as set forth in claim 14 wherein:

(a) each end bar is releasably connected to a respective end of said center bar.

18. A device as set forth in claim 14 wherein each end bar includes:

(a) a fastening mechanism to enable releasable:connection of a weight member thereto.

19. A device as set forth in claim 14 wherein:

(a) each end bar includes threaded opposite ends; and (c) a threaded grip collar is received on each threaded opposite end to releasably retain a weight member thereon.

20. A device as set forth in claim 14 wherein:

(a) each said grip member is generally cylindrical and has a grip diameter in a range of approximately four to six inches.

21. A device as set forth in claim 14 wherein:

(a) said center bar is adjustable in length to enable selective variation in spacing between said grip members.

* * * * *